US010535922B2

(12) United States Patent
Wu

(10) Patent No.: US 10,535,922 B2
(45) Date of Patent: Jan. 14, 2020

(54) HOST WITH MULTIPLE ANTENNAS

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventor: Tuan-Chung Wu, New Taipei (TW)

(73) Assignees: HONGFUJIN PRECISION INDUSTRY (WUHAN) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 4 days.

(21) Appl. No.: 15/990,765

(22) Filed: May 28, 2018

(65) Prior Publication Data

US 2019/0319351 A1 Oct. 17, 2019

(30) Foreign Application Priority Data

Apr. 16, 2018 (CN) ..... 2018 1 0338175

(51) Int. Cl.

| | |
|---|---|
| ***H01Q 1/24*** | (2006.01) |
| ***H01Q 1/52*** | (2006.01) |
| ***H01Q 9/04*** | (2006.01) |
| ***H01Q 5/20*** | (2015.01) |

(52) U.S. Cl.

CPC ..... *H01Q 1/523* (2013.01); *H01Q 1/24* (2013.01); *H01Q 5/20* (2015.01); *H01Q 9/0421* (2013.01)

(58) Field of Classification Search

CPC ..... H01Q 1/523; H01Q 5/20; H01Q 1/24; H01Q 9/0421; H01Q 1/38; H01Q 1/243; H01Q 21/28; A63F 13/235; A63F 13/23; A63F 2300/1031

See application file for complete search history.

(56) References Cited

U.S. PATENT DOCUMENTS

| | | | | |
|---|---|---|---|---|
| 5,898,413 | A * | 4/1999 | Mandai | H01Q 1/243 343/702 |
| 2004/0257283 | A1* | 12/2004 | Asano | H01Q 1/243 343/702 |
| 2007/0176829 | A1* | 8/2007 | Liu | H01Q 9/0421 343/702 |

* cited by examiner

*Primary Examiner* — Dameon E Levi
*Assistant Examiner* — David E Lotter
(74) *Attorney, Agent, or Firm* — ScienBiziP, P.C.

(57) ABSTRACT

A host with multiple antennas so as to be capable of Wi-Fi and X-box functioning includes a chassis, and first to fourth antennas. The first antenna and the second antenna are each on an edge area of a first side wall of the chassis, the third antenna is located on a second side wall of the chassis, and the fourth antenna is located on a third side wall of the chassis. The first side wall is located between the second side wall and the third side wall, and the second side wall is located opposite to the third side wall. A separation distance between every two antennas of the first to fourth antennas is greater than a predetermined distance and enables isolation requirements for all antenna types to be met.

20 Claims, 7 Drawing Sheets

HOST WITH MULTIPLE ANTENNAS

FIELD

The subject matter herein generally relates to wireless communication.

BACKGROUND

A computer host may comprise a plurality of antennas. Mutual interference may occur between two or more antennas.

BRIEF DESCRIPTION OF THE DRAWINGS

Implementations of the present technology will now be described, by way of example only, with reference to the attached figures.

DETAILED DESCRIPTION

Figure 1:
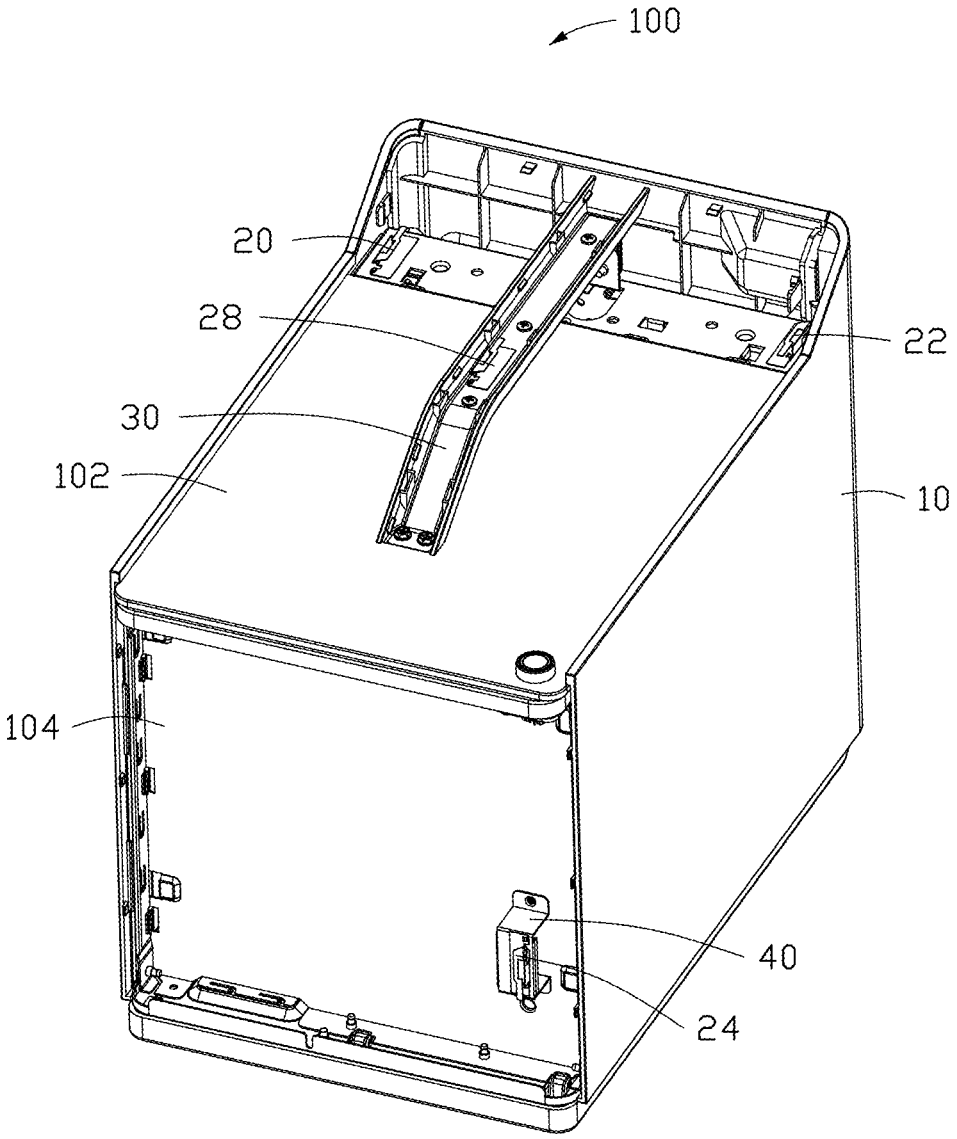
FIG. 1 is an isometric view of an embodiment of a host with multiple antennas.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure. It should be noted that references to "an" or "one" embodiment in this disclosure are not necessarily to the same embodiment, and such references mean "at least one".

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

FIG. 1 illustrates a multi-antenna host 100 in accordance with an embodiment. The multi-antenna host 100 may be a desktop host.

Figure 2:
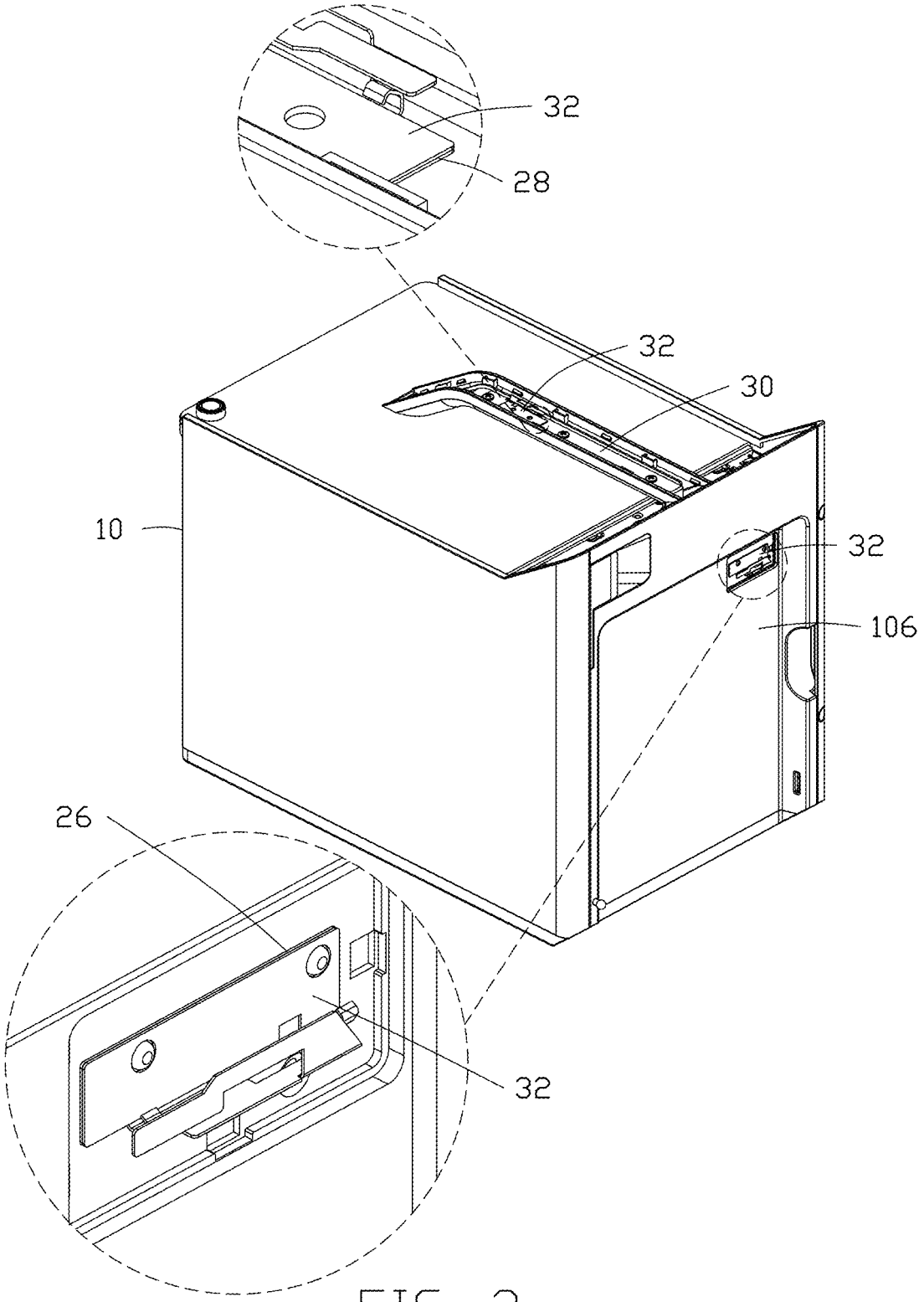
FIG. 2 is similar to FIG. 1, but shown from another angle.

The multi-antenna host 100 comprises a chassis 10, a first antenna 20, a second antenna 22, a third antenna 24, a fourth antenna 26 (as shown in FIG. 2), and a fifth antenna 28 (as shown in FIG. 2). The chassis 10 may be a quasi-cuboid shape and comprise six side walls. The first antenna 20 and the second antenna 22 are each located on an edge area of a first side wall 102 of the chassis 10. The third antenna 24 is located on a second side wall 104 of the chassis 10 and the fourth antenna 26 is located on a third side wall 106 of the chassis 10. The first side wall 102 is located between the second side wall 104 and the third side wall 106, and the second side wall 104 is located opposite to the third side wall 106.

The multi-antenna host 100 further comprises a carrying handle 30. The carrying handle 30 is installed on a middle area of the first side wall 102, and the fifth antenna 28 is set in the carrying handle 30. To avoid antenna interference among the antennas 20-28, a separation distance between every two antennas is greater than a predetermined distance.

In one embodiment, the carrying handle 30 can be made of insulating materials. The carrying handle 30 is made of plastic for example. The predetermined distance can be 150 millimeters for example.

In one embodiment, the first antenna 20 is arranged parallel to the second antenna 22, the third antenna 24 is arranged vertical to the first antenna 20, and the fourth antenna 26 is arranged vertical to the first antenna 20. The antennas 20-26 are orthogonally arranged in the space. Each antenna 20-26 can thus have good transmitting/receiving efficiency.

In one embodiment, the first antenna 20 and the second antenna 22 are arranged symmetrically relative to the carrying handle 30.

Referring to FIG. 2, the multi-antenna host 100 comprises a plurality of antenna covers 32, each of the plurality of antenna covers 32 covers an antenna. For example, the multi-antenna host 100 comprises five antenna covers to protect the first antenna 20, the second antenna 22, the third antenna 24, the fourth antenna 26, and the fifth antenna 28.

In one embodiment, the first antenna 20 can be a first X-Box (X-Box gaming console) antenna and a frequency of the first X-Box antenna can be 2.4 GHz. The second antenna 22 can be a second X-Box antenna and a frequency of the second X-Box antenna can be 5 GHz. The third antenna 24 can be a first Wi-Fi antenna and a frequency of the first Wi-Fi antenna can be 2.4 GHz. The fourth antenna 26 can be a second Wi-Fi antenna and a frequency of the second Wi-Fi antenna can be 5 GHz. The fifth antenna 28 can be a third X-Box antenna and a frequency of the third X-Box antenna can be 5 GHz.

In one embodiment, the multi-antenna host 100 further comprises an antenna bracket 40. A location of the third antenna 24 comprises a plurality of metal parts and the third antenna 24 is located on the antenna bracket 40 to avoid being sheltered by such metal parts.

Figure 3:
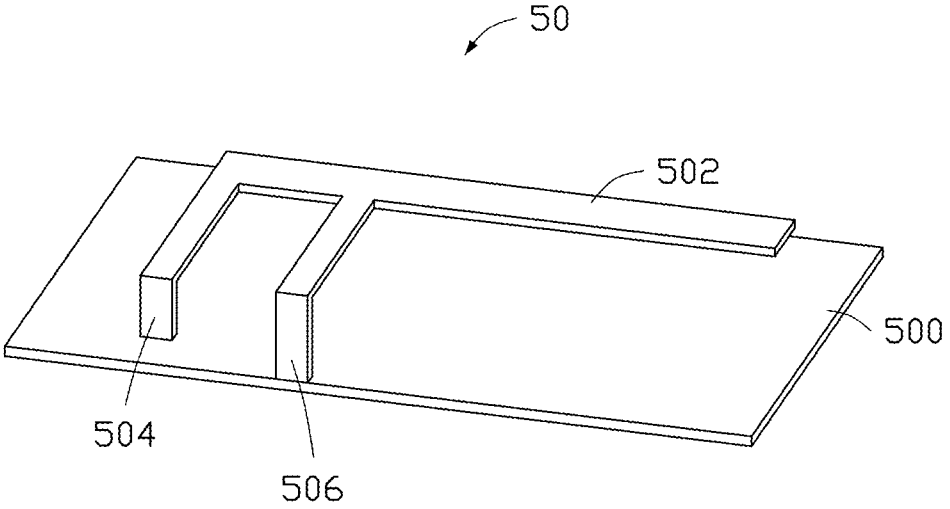
FIG. 3 is a stereoscopic view of an embodiment of an inverted-F antenna of the multiple antennas of FIG. 1.

Referring to FIG. 3, the first antenna 20, the second antenna 22, the third antenna 24, the fourth antenna 26, and the fifth antenna 28 are inverted-F antennas 50. The sizes of the first antenna 20, the second antenna 22, the third antenna 24, the fourth antenna 26, and the fifth antenna 28 are each different. The inverted-F antenna 50 comprises a base board 500, a radiating portion 502, a feeding portion 504, and a ground portion 506. The radiating portion 502 is parallel to the base board 500, and the feeding portion 504 and the ground portion 506 are vertically coupled to the radiating portion 502.

Figure 4:
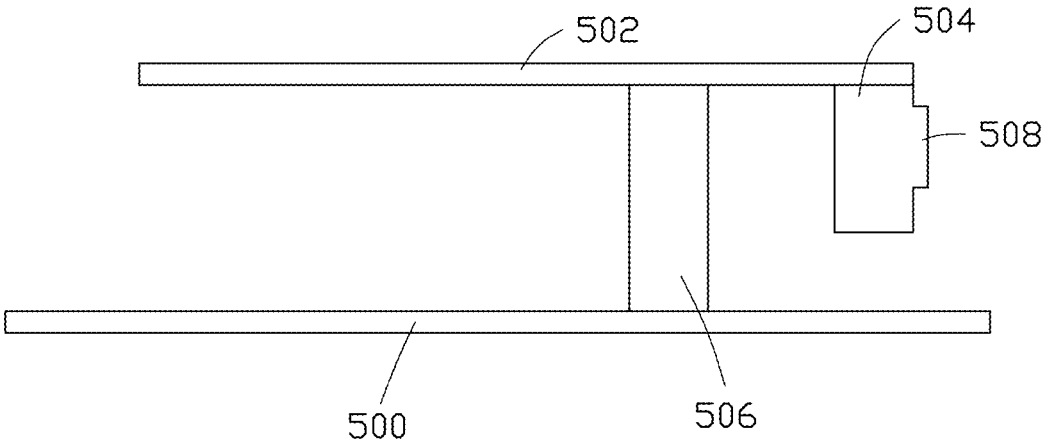
FIG. 4 is a side view of an embodiment of the inverted-F antenna of FIG. 3.

Referring to FIG. 4, the ground portion 506 is vertically coupled to the base board 500, and the feeding portion 504 is vertical to the base board 500. The feeding portion 504 and the base board 500 define an interval D1 therebetween. The feeding portion 504 comprises a feeding point 508 and a signal flows to the feeding point 508 to activate the radiating portion 502.

Figure 5:
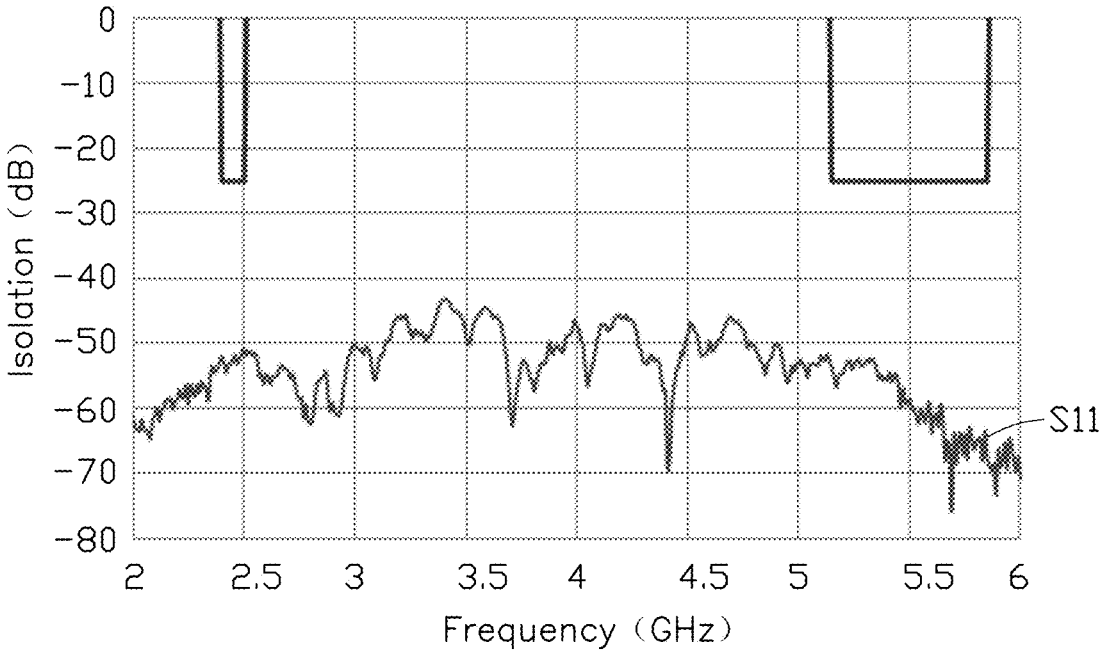
FIG. 5 is an isolation parameter graph of an embodiment of two Wi-Fi antennas of the multiple antennas of FIG. 1.

FIG. 5 illustrates an embodiment of a first isolation parameter graph S11 as between the third antenna 24 and the fourth antenna 26. As FIG. 5 shows, a first isolation between the third antenna 24 and the fourth antenna 26 is less than −50 dB in 2.4 GHz frequency and 5 GHz frequency. The first isolation between the third antenna 24 and the fourth antenna 26 matches isolation requirement as between two Wi-Fi antennas.

Figure 6:
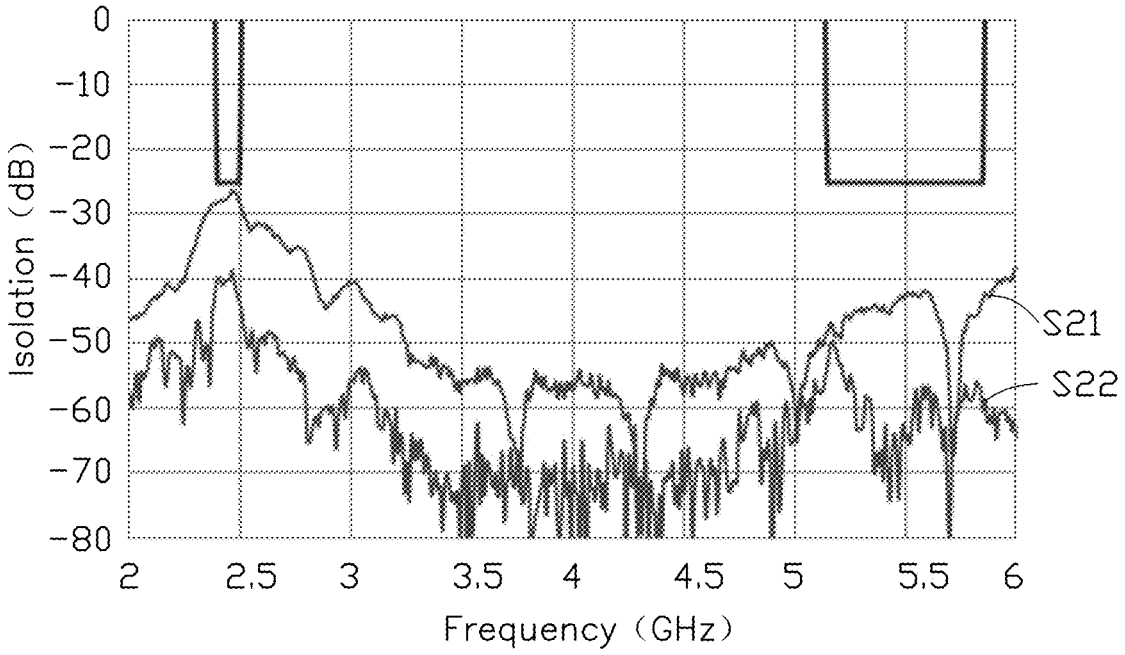
FIG. 6 is an isolation parameter graph of an embodiment of a 2.4 GHz X-Box antenna and the two Wi-Fi antennas of the multiple antennas of FIG. 1.

FIG. 6 illustrates an embodiment of a second isolation parameter graph S21 as between the first antenna 20 and the third antenna 24. A third isolation parameter graph S22 between the first antenna 20 and the fourth antenna 26 is also shown. According to FIG. 6, a second isolation between the first antenna 20 and the third antenna 24 is less than −25 dB in 2.4 GHz frequency and 5 GHz frequency, and a third isolation between the first antenna 20 and the fourth antenna 26 is also less than −25 dB in 2.4 GHz frequency and 5 GHz. The second isolation and the third isolation match isolation requirement as between a 2.4 GHz X-Box antenna and a Wi-Fi antenna.

Figure 7:
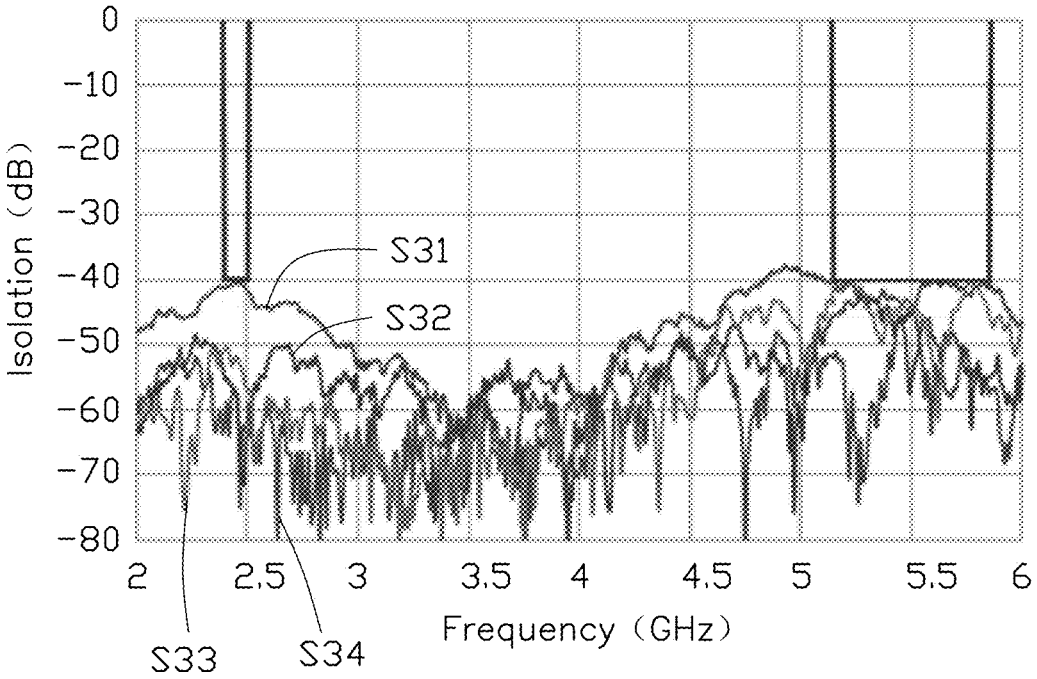
FIG. 7 is an isolation parameter graph of an embodiment of two 5 GHz X-Box antennas and the two Wi-Fi antennas of the multiple antennas of FIG. 1.

FIG. 7 illustrates an embodiment of a fourth isolation parameter graph S31 as between the second antenna 22 and the third antenna 24, and a fifth isolation parameter graph S32 as between the fifth antenna 28 and the third antenna 24. A sixth isolation parameter graph S33 between the second antenna 22 and the fourth antenna 26, and a seventh isolation parameter graph S34 between the fifth antenna 28 and the fourth antenna 26 are also shown. According to FIG. 7, a fourth isolation between the second antenna 22 and the third antenna 24 is less than −40 dB in 2.4 GHz frequency and 5 GHz frequency, and a fifth isolation between the fifth antenna 28 and the third antenna 24 is less than −40 dB in 2.4 GHz frequency and 5 GHz. The sixth isolation between the second antenna 22 and the fourth antenna 26 is less than −40 dB in 2.4 GHz frequency and 5 GHz frequency, and the seventh isolation between the fifth antenna 28 and the fourth antenna 26 is also less than −40 dB in 2.4 GHz frequency and 5 GHz. The fourth isolation, the fifth isolation, the sixth isolation, and the seventh isolation match isolation requirements between a 5 GHz X-Box antenna and a Wi-Fi antenna.

The embodiments shown and described above are only examples. Many details known in the field are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A multi-antenna host comprising:

a chassis being a quasi-cuboid shape and comprising a first side wall, a second side wall, and a third side wall;

a first antenna;

a second antenna;

a third antenna;

a fourth antenna; and a fifth antenna;

wherein the first antenna and the second antenna are each located on an edge area of the first side wall, the third antenna is located on the second side wall, and the fourth antenna is located on the third side wall; the first side wall is located between the second side wall and the third side wall, the second side wall is located opposite to the third side wall, a carrying handle is installed on the first side wall, and the fifth antenna is set in the carrying handle; and a separation distance between every two antennas of the first antenna, the second antenna, the third antenna, the fourth antenna, and the fifth antenna is greater than a predetermined distance.

2. The multi-antenna host of claim 1, wherein the carrying handle is installed on a middle area of the first side wall.

3. The multi-antenna host of claim 2, wherein the first antenna and the second antenna are arranged symmetrically relative to the carrying handle.

4. The multi-antenna host of claim 2, wherein the predetermined distance is 150 millimeters.

5. The multi-antenna host of claim 2, wherein the first antenna is a first X-Box gaming console antenna and a frequency of the first X-Box gaming console antenna is 2.4 GHz; the second antenna is a second X-Box gaming console antenna and a frequency of the second X-Box gaming console antenna is 5 GHz; the third antenna is a first wireless fidelity (Wi-Fi) antenna and a frequency of the first Wi-Fi antenna is 2.4 GHz; the fourth antenna is a second Wi-Fi antenna and a frequency of the second Wi-Fi antenna is 5 GHz; and the fifth antenna is a third X-Box gaming console antenna and a frequency of the third X-Box gaming console antenna is 5 GHz.

6. The multi-antenna host of claim 2, wherein the first antenna, the second antenna, the third antenna, the fourth antenna, and the fifth antenna are inverted-F antennas; the inverted-F antenna comprises a base board, a radiating portion, a feeding portion, and a ground portion; the radiating portion is parallel to the base board, the feeding portion and the ground portion are vertically coupled to the radiating portion.

7. The multi-antenna host of claim 6, wherein the ground portion is vertically coupled to the base board, the feeding portion is vertical to the base board, and the feeding portion and the base board define an interval therebetween.

8. The multi-antenna host of claim 2, further comprising an antenna bracket, wherein the third antenna is located on the antenna bracket to avoid being sheltered by metal parts.

9. The multi-antenna host of claim 2, wherein the first antenna is arranged parallel to the second antenna, the third antenna is arranged vertical to the first antenna, and the fourth antenna is arranged vertical to the first antenna.

10. A multi-antenna host comprising:

a chassis being a quasi-cuboid shape and comprising a first side wall, a second side wall, and a third side wall;

a first antenna;

a second antenna;

a third antenna;

a fourth antenna;

a fifth antenna; and a plurality of antenna covers, each of the plurality of antenna covers is configured to cover each antenna;

wherein the first antenna and the second antenna are each located on an edge area of the first side wall, the third antenna is located on the second side wall, and the fourth antenna is located on the third side wall; the first side wall is located between the second side wall and the third side wall, the second side wall is located opposite to the third side wall, a carrying handle is installed on the first side wall, and the fifth antenna is set in the carrying handle; and a separation distance between every two antennas of the first antenna, the second antenna, the third antenna, the fourth antenna, and the fifth antenna is greater than a predetermined distance.

11. The multi-antenna host of claim 10, wherein the carrying handle is installed on a middle area of the first side wall.

12. The multi-antenna host of claim 11, wherein the first antenna and the second antenna are arranged symmetrically relative to the carrying handle.

13. The multi-antenna host of claim 11, wherein the predetermined distance is 150 millimeters.

14. The multi-antenna host of claim 11, wherein the first antenna is a first X-Box gaming console antenna and a frequency of the first X-Box gaming console antenna is 2.4 GHz; the second antenna is a second X-Box gaming console antenna and a frequency of the second X-Box gaming console antenna is 5 GHz; the third antenna is a first wireless fidelity (Wi-Fi) antenna and a frequency of the first Wi-Fi antenna is 2.4 GHz; the fourth antenna is a second Wi-Fi antenna and a frequency of the second Wi-Fi antenna is 5 GHz; and the fifth antenna is a third X-Box gaming console antenna and a frequency of the third X-Box gaming console antenna is 5 GHz.

15. The multi-antenna host of claim 11, wherein the first antenna, the second antenna, the third antenna, the fourth antenna, and the fifth antenna are inverted-F antennas; the inverted-F antenna comprises a base board, a radiating portion, a feeding portion, and a ground portion; the radiating portion is parallel to the base board, the feeding portion and the ground portion are vertically coupled to the radiating portion.

16. The multi-antenna host of claim 15, wherein the ground portion is vertically coupled to the base board, the feeding portion is vertical to the base board, and the feeding portion and the base board define an interval therebetween.

17. The multi-antenna host of claim 10, further comprising an antenna bracket, wherein the third antenna is located on the antenna bracket to avoid being sheltered by metal parts.

18. The multi-antenna host of claim 10, wherein the first antenna is arranged parallel to the second antenna, the third antenna is arranged vertical to the first antenna, and the fourth antenna is arranged vertical to the first antenna.

19. The multi-antenna host of claim 11, further comprising an antenna bracket, wherein the third antenna is located on the antenna bracket to avoid being sheltered by metal parts.

20. The multi-antenna host of claim 11, wherein the first antenna is arranged parallel to the second antenna, the third antenna is arranged vertical to the first antenna, and the fourth antenna is arranged vertical to the first antenna.

* * * * *